US007921556B2

(12) United States Patent
Bracken et al.

(10) Patent No.: US 7,921,556 B2
(45) Date of Patent: Apr. 12, 2011

(54) FULLY BLADED CLOSURE FOR TANGENTIAL ENTRY ROUND SKIRT DOVETAILS

(75) Inventors: Robert James Bracken, Niskayuna, NY (US); John C. Lavash, Niskayuna, NY (US); Praveen Kumar Garlapati, Hyderabad (IN)

(73) Assignee: General Electric Company, Schenectady, NY (US)

( * ) Notice: Subject to any disclaimer, the term of this patent is extended or adjusted under 35 U.S.C. 154(b) by 838 days.

(21) Appl. No.: 11/839,888

(22) Filed: Aug. 16, 2007

(65) Prior Publication Data

US 2009/0047128 A1 Feb. 19, 2009

(51) Int. Cl.
*B23P 6/00* (2006.01)
*F01D 5/30* (2006.01)
*F01D 5/32* (2006.01)

(52) U.S. Cl. ..... 29/889.1; 29/889.21; 29/401.1; 416/216; 416/218; 416/222

(58) Field of Classification Search ..... 416/215–218, 416/219 R, 220 R, 221, 222; 29/401.1, 402.03, 29/402.08, 402.09, 402.14, 889.1, 889.21, 29/889.22

See application file for complete search history.

(56) References Cited

U.S. PATENT DOCUMENTS

| | | | | |
|---|---|---|---|---|
| 4,702,673 | A * | 10/1987 | Hansen et al. | 416/215 |
| 4,730,984 | A * | 3/1988 | Ortolano | 416/222 |
| 6,168,382 | B1 * | 1/2001 | Nolan et al. | 416/220 R |
| 6,499,959 | B1 | 12/2002 | Reluzco et al. | |
| 6,755,618 | B2 | 6/2004 | Munshi et al. | |
| 7,261,518 | B2 * | 8/2007 | Golinkin et al. | 416/215 |

FOREIGN PATENT DOCUMENTS

| | | | | |
|---|---|---|---|---|
| JP | 59-221403 A | * | 12/1984 | 416/222 |
| JP | 60-147504 A | * | 8/1985 | 416/222 |

* cited by examiner

*Primary Examiner* — Christopher Verdier
(74) *Attorney, Agent, or Firm* — Edward J. Smith; Ernest G. Cusick; Frank A. Landgraff

(57) ABSTRACT

A fully bladed closure design for a turbine wheel with tangential entry. A set of the final three buckets including a bladed closure bucket are disposed about a wheel margin with two buckets adjacent to the bladed closure bucket secured to the wheel margin by the dovetails. The closure bucket is secured to adjacent buckets by a combination of one or more retaining keys and to the margin by one or more retaining pins. The bladed closure bucket and the adjoining faces of the adjacent buckets have flat skirts providing suppport from the retaining keys across the full axial width of the bladed closure bucket and the adjacent buckets.

4 Claims, 7 Drawing Sheets

FULLY BLADED CLOSURE FOR TANGENTIAL ENTRY ROUND SKIRT DOVETAILS

BACKGROUND OF THE INVENTION

The invention relates generally to replacing a bladeless closure piece in a turbine wheel to improve the efficiency of operation of the turbine wheel and more specifically to providing a fully bladed closure design for tangential entry round skirt dovetails.

Steam turbine blades, or buckets, are often designed for installation on a turbine wheel in a tangential direction. The buckets are typically attached to the turbine wheel using external circumferential dovetails, with a male dovetail on the wheel periphery (margin) and a complimentary female dovetail in the base or root of the bucket. In order to load these buckets onto the wheel, a notch which locally removes the male dovetail portions is cut on the periphery of the wheel, leaving a generally rectangular core portion. Each bucket is then initially located over the core material in the notch and then displaced tangentially onto and around the wheel. The last bucket to be assembled to the wheel is called the closure block. Once all the buckets have been loaded, a closure block is utilized that is formed with laterally spaced tangs extending radially inwardly and that are adapted to straddle the core material in the notch. The closure block is secured by a retaining pin passing through the tangs and core. In this way, the buckets on the wheel are locked in place and thus prevent the buckets from moving circumferentially along the dovetail.

Front or first stage turbine buckets are subjected to high temperatures over 900 degrees F. Limitations of material stress capability mean that only a lightweight block, which has no airfoil, can be used as the closure block, causing reduced performance. Buckets for other stages may also be subjected to high temperatures and great stresses. Because the closure block has no airfoil, there is an opening in the steam path with detrimental effects on performance of the wheel. The reason behind the inability to support an airfoil on the closure bucket is the fact that the retaining pin passes through the core material in the highly stressed dovetail region of the wheel. There is thus a need for a closure block with a mounting or retaining arrangement that provides sufficient strength to permit the incorporation of an integral airfoil that closes the opening, thus producing greater performance.

Referring to FIG. 1, a typical turbine rotor or wheel 10 (partially shown) includes a male dovetail configuration 12 formed about the periphery of the wheel, with upper and lower axial projections 14, 16 (projecting outwardly from both sides of the wheel) as conventionally provided. A notch (or insertion gap) (not shown) with a width adequate to permit the female dovetail portion of buckets to slide over is provided. Further, an axial oriented hole 25 is provided through the notch. Buckets 18 having an airfoil 20, a platform 22 and a root or base portion 24 are shown loaded onto the wheel 10. It will be understood that the closure block is the last of a circumferential row of buckets to be loaded on the wheel. The closure block 26 is shown inserted over the notch, formed by removing the projections 14, 16 on opposite sides of the dovetail. A pair of tangs (one shown at 30) straddles the remaining core material of the dovetail. A retaining pin 32 is press fit into aligned openings in the core and the tangs 30. Because the stresses at the location of pin 32 are high, the closure block 26 cannot support an airfoil, and thus an undesirable space 34 is left unfilled.

The closure bucket typically does not have a dovetail to provide support because a dovetail would be useless in the notched space that the closure bucket occupies. Therefore, the closure bucket must be secured by other means. Various arrangements have been attempted to provide a bladed closure bucket.

One approach by Reluzco et al. (U.S. Pat. No. 6,499,959) was to fix the closure bucket to adjacent buckets, i.e., the two buckets that straddle the gap and the closure bucket, in order to secure the closure bucket to the wheel. Typically, the closure bucket is attached to the adjacent buckets by pins extending in an axial direction engaging through the root or base portions of the adjacent buckets and the closure bucket. Here, the centrifugal load of the closure bucket is carried by the adjacent buckets through the pins. The applied loads on the closure and adjacent buckets are thus not uniform. High localized stresses are encountered at the location of the securing between the closure bucket and the two adjacent wheels, i.e., along the slots receiving the pins and the pins themselves. Consequently, creep and permanent deformation of the closure bucket and/or the adjacent buckets may occur after a period of operation at high temperatures and high centrifugal loads. For example, such high temperatures and loadings may occur in the reheat section of an intermediate stage turbine. As a result, the closure bucket may tend to elongate at its base or root in response to these high temperatures and stresses over time, with the result that the slot or hole for receiving the pins may elongate in a radial outward direction. Consequently, there is a need for an increase in the load-carrying capacity of at least the closure bucket in a steam turbine.

To avoid creep failure, the closure bucket and preferably the two adjacent buckets are formed of a material having a higher strength, e.g., a higher creep rupture strength than the creep rupture strength of material forming the remaining buckets. For example, the remaining buckets may be typically formed of a stainless steel. The material of the closure and adjoining buckets, however, may comprise a nickel-based alloy and more particularly and preferably an Inconel-based alloy. Additionally, the pins 32 are preferably formed of a material having a higher creep rupture strength than the creep rupture strength of the remaining buckets. Thus in Reluzco, the pins are preferably formed of a similar material as the closure and adjacent buckets, although it will be appreciated that the pins may be formed of a different material having a higher creep rupture strength than the creep rupture strength of the stainless steel buckets.

In Munshi et al. (U.S. Pat. No. 6,755,618), another method for supporting a fully bladed closure block was provided. Here , as shown in FIG. 2, the notch for loading buckets onto the turbine wheel 38 was cut deeper in the radial direction than the typical notch for a closure. Again, the periphery of the wheel is formed with a male dovetail 40 including projections 42, 44 that cooperate with complimentary female dovetails (not shown) formed in the buckets. The closure bucket 36 is inserted onto notch 46, after all of the other buckets in the row are installed. The notch 46 at the bucket loading location is deeper in a radial direction than typically formed notches (like the notch described for FIG. 1), and the closure bucket 36 is formed with a root portion 47 that includes extended radial tangs 48, 50, each provided with a pair of radially aligned holes 52, 54 (one pair shown on tang 50). Holes 52, 54 of one tang are also axially aligned with the holes in the other tang. Because of the extended radial depth of the notch 46 and tangs 48, 50, radially aligned retaining pins 56, 58 used to secure the closure bucket 36 pass through the core of the wheel 38 entirely radially inside the dovetail 40 formed on the periphery of the wheel, providing extra support for the closure bucket to have an integral airfoil 60. However, the deeper cut requires specialized machining.

Accordingly, there is a need to provide a fully bladed closure design for a turbine wheel with round skirt dovetails that can tolerate centrifugal loads and high temperatures without resorting to special strength material or making deep cuts on the notch in the peripheral margin of the wheel.

BRIEF DESCRIPTION OF THE INVENTION

The present invention relates to providing a turbine wheel employing a set of buckets with round skirt dovetails with a fully bladed closure design and also providing a method for retrofitting the fully bladed closure design to existing turbine wheels with unbladed closure pieces.

Briefly in accordance with one aspect of the present invention, a turbine wheel providing a fully bladed closure design is provided. The turbine wheel includes a male dovetail with upper and lower axial projections formed on substantially an entire periphery of the wheel. The dovetail projections are interrupted by a notch formed through removal of portions of the male dovetail at a bucket loading location on the periphery of the wheel. Also provided for the turbine wheel is a bladed closure bucket, including a root portion, a platform and an airfoil. The root portion is formed with a pair of radially inwardly extending laterally spaced tangs, and the platform is formed with a flat skirt on each circumferential face. Further included is a pair of adjacent buckets, one adjacent bucket assembled on each side of the bladed closure bucket. The adjacent buckets include a root portion, a platform and an airfoil. The root portion is formed with a female dovetail complementary to the male dovetail on the wheel and the platform is formed with a flat skirt on a circumferential face adjacent to the bladed closure bucket and with a rounded skirt on the circumferential face opposed to the bladed closure bucket. A plurality of buckets is assembled on the wheel to fill remaining space on the periphery. The buckets include a root portion, a platform and an airfoil, wherein the root portion is formed with a female dovetail complementary to the male dovetail on the wheel and the platform is formed with rounded skirts.

In accordance with another aspect of the present invention, a set of bladed buckets for retrofitting a bladeless closure bucket design on a turbine wheel is provided. A male dovetail is formed on substantially an entire periphery of the wheel, interrupted by a notch formed by removal of portions of the male dovetail at a bucket loading location on the periphery of the wheel. The male dovetail includes upper and lower axial projections formed on substantially an entire periphery of the wheel.

The set of bladed buckets includes a bladed closure bucket with a root portion, a platform and an airfoil. The root portion of the bladed closure bucket is formed with a pair of radially inwardly extending laterally spaced tangs, and the platform is formed with a flat skirt on each circumferential face. The set of bladed buckets includes a pair of adjacent bladed buckets for assembly on each side of the bladed closure bucket, with a root portion, a platform and an airfoil. The root portion of the adjacent bladed buckets is formed with a female dovetail complementally to the male dovetail on the wheel. The platform is formed with a flat skirt on a circumferential face adjacent to the bladed closure bucket and with a round skirt on a circumferential face opposed to the bladed closure bucket.

According to a further aspect of the present invention, a method for retrofitting a bladeless closure design of tangential entry round skirt buckets and a non-bladed closure bucket in a turbine wheel with a fully bladed closure is provided. The method includes removing the bladeless closure bucket from the wheel, removing an adjacent trailing bucket with a round skirt from the wheel, and removing an adjacent leading bucket with a round skirt from the wheel. The method further includes installing an adjacent leading bucket including a round skirt on a leading edge and a flat skirt on a trailing edge, through the closure notch onto a peripheral margin of the wheel, and installing an adjacent trailing bucket, including a round skirt on a trailing edge and a flat skirt on a leading edge, through the closure notch onto the peripheral margin of the wheel. A bladed closure bucket with a flat skirt on a leading edge and a trailing edge is installed through the closure notch onto the peripheral margin of the wheel.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including improving the performance of turbine wheels with round skirt dovetails by providing a fully bladed closure design. Also provided is a method for retrofitting an unbladed closure design on existing turbine wheels with round skirt dovetails utilizing a bladed closure design.

The fully bladed closure design for a tangential entry round skirt dovetail utilizes 3 bladed buckets, including a bladed closure bucket and an adjacent bladed bucket on each side of the bladed closure bucket. The adjacent bladed buckets provide a flat skirt dovetail on their circumferential face adjacent to the bladed closure bucket and a round skirt dovetail on the circumferential face opposing the bladed closure bucket. The flat skirt at the interface of the bladed closure bucket and the adjacent bladed bucket allows the full width of the flat skirt on each face to support a retaining key there-between.

Figure 3A:
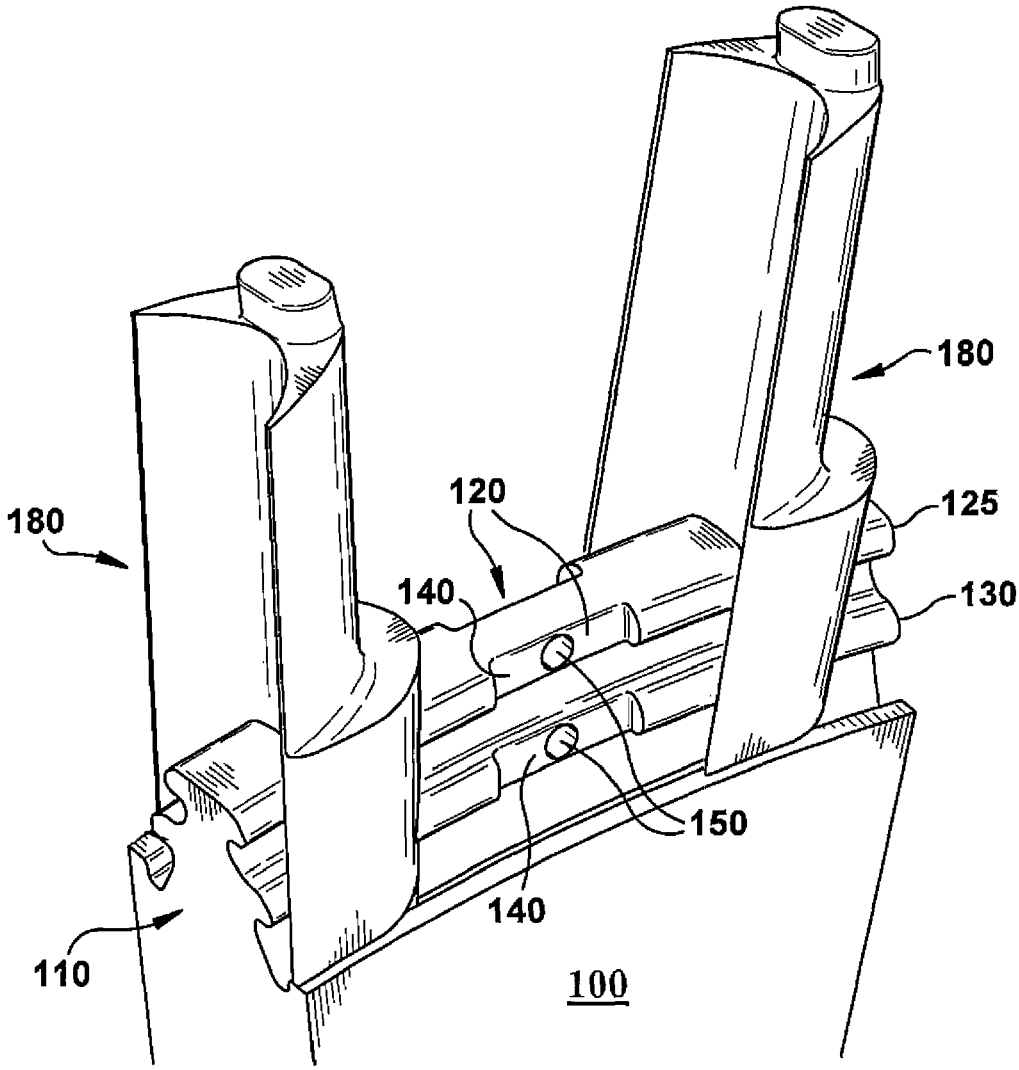
FIG. 3A illustrates an exemplary inventive turbine wheel including a male dovetail portion on substantially an entire periphery of the wheel.
Figure 3B:
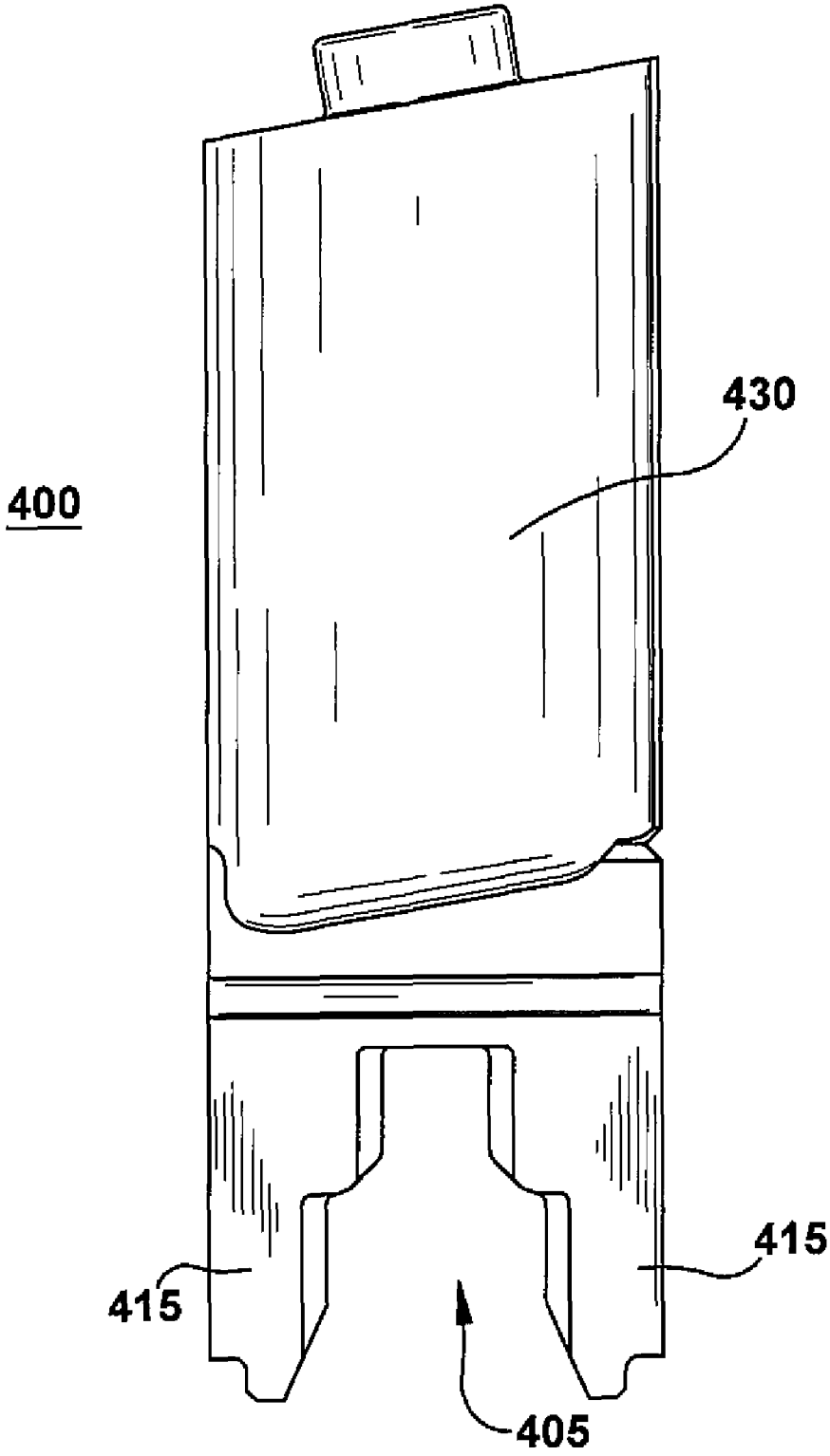
FIG. 3B illustrates an exemplary closure bucket including a female mating portion for a closure notch.

FIG. 3A illustrates an exemplary inventive turbine wheel including a male dovetail portion on substantially an entire periphery of the wheel. The turbine wheel 100 includes a male dovetail 110 portion on substantially an entire periphery 110 of the wheel. The male dovetail 110 may include an upper projection 125 and a lower projection 130. The two projections or hooks facilitate mating with a complementary female structure on the root of the bucket. A notch 120, ,formed by removal of portions of the male dovetail is located at a bucket loading location on the periphery of the wheel. As shown, the notch faces 140 form a flat surface in a generally radial direction and circumferential direction. Two bladed buckets 180 are mounted on the periphery of the wheel. The notch is illustrated with two retaining holes 150 for cross pins (not installed). FIG. 3B illustrates a tangential view of a bladed closure bucket 400 with blade 430, including a female mating portion for the closure notch. Female mating surfaces 405 of the bladed closure bucket 400 are provided to seat the bucket on the notch 120 of FIG. 3A. The notch 120 and the female mating surfaces 105 may be provided with generally flat surfaces. Alternatively, the notch and the female mating surfaces 405 of the tangs 415 may be tapered.

Figure 4A:
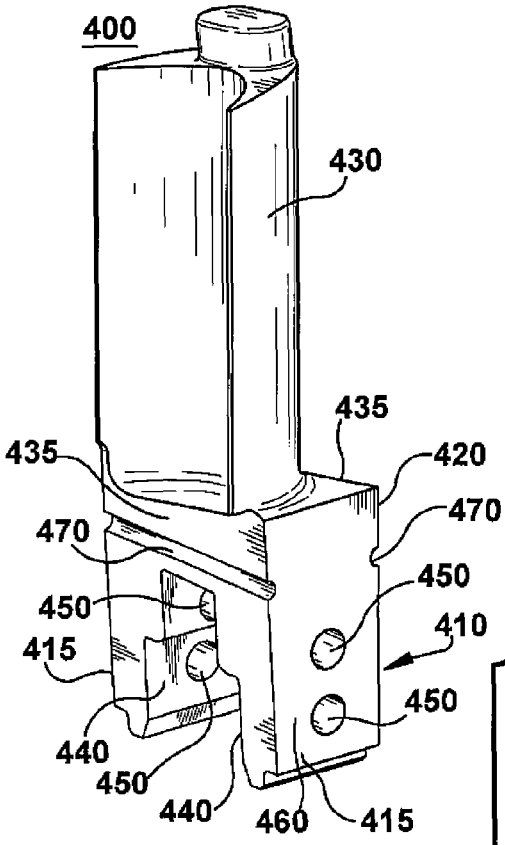
FIG. 4A illustrates an exemplary inventive bladed closure bucket.
Figure 4B:
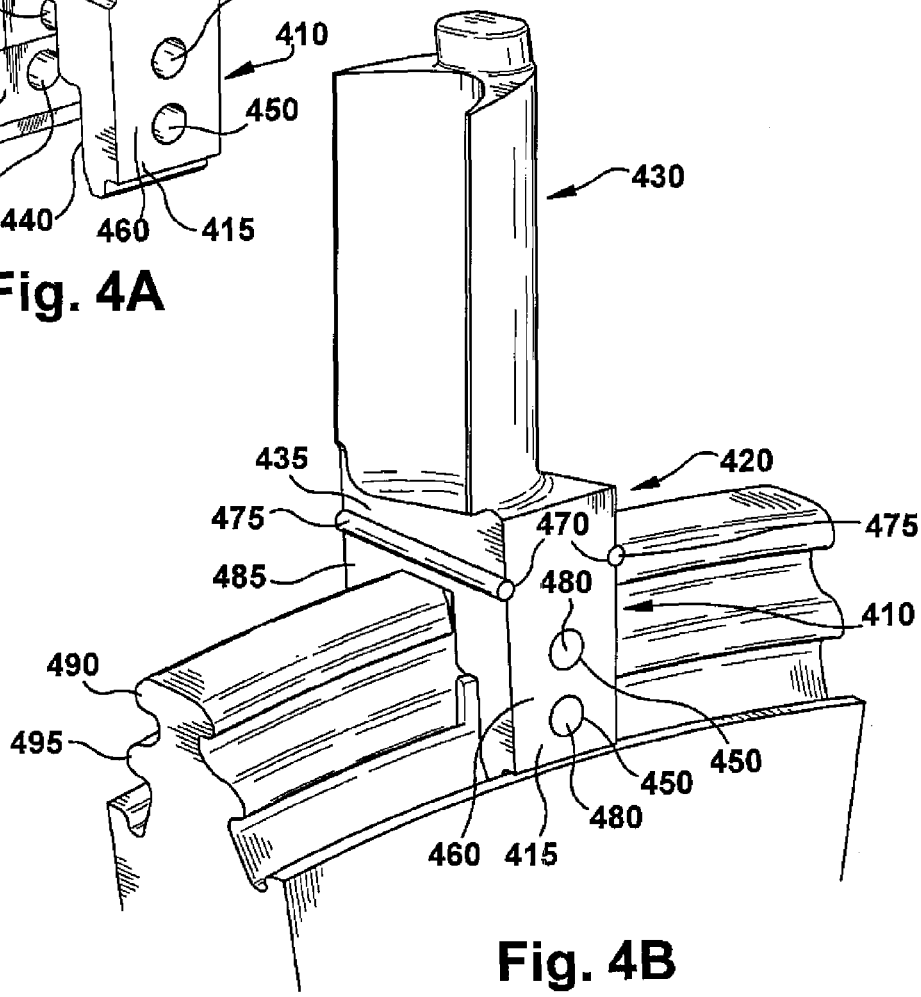
FIG. 4B illustrates an exemplary inventive bladed closure bucket standing alone on the notch of a turbine wheel.

FIG. 4A illustrates an exemplary inventive bladed closure bucket. FIG. 4B illustrates an exemplary inventive bladed closure bucket standing alone on the notch of a turbine wheel. The bladed closure bucket 400 may include a root portion 410, a platform 420 and an airfoil 430, the root portion 410 formed with a pair of radially inwardly extending laterally spaced tangs 415, and the platform 420 formed with a flat skirt 435 on each circumferential face. The tangs 415 define an opening between them and are adapted to straddle the notch (FIG. 3A, 120) on the wheel. Each tang 415 may include inner faces 440 complementary to the shape of the notch. The outer axial surface 460 of the root is generally flat. The outer axial surface 460 at the tangs 415 may include one or more retaining holes 450, where the retaining holes 450 extend axially through the tangs 415.

The bladed closure bucket may also include a flat surface (skirt) on each circumferential face of the root. The flat skirt 435 on each circumferential face of the root 410 includes a at least one retaining hole 470, generally semicircular in shape and aligned radially with a complementary semicircular hole in the adjacent circumferential face of the adjacent bladed bucket. The at least one retaining hole 470 extends fully across the axial width of the skirt 435. Together these holes define placement for a circular retaining key 475 that provides support from the adjacent blades to lock the bladed closure bucket 400 in place. The retaining holes 470 may be realized with one hole or more holes at each interface, thereby employing one or more keys to provide support for the bladed closure bucket 400. By utilizing a bladed closure bucket 470 with a flat skirt 435, the key will be provided support across the full width of the bucket, adding stability to the bucket and providing sufficient surface support to overcome a hook shear imposed on the bucket.

In addition to the retaining keys, the bladed closure bucket may also be provided with at least one retaining pin (cross pin) 480 that extends axially through the matching retaining hole 450 in each tang 415. The retaining holes 450 for the pins 480 are generally centered on the tangs 415 between the circumferential faces of the bladed closure bucket. If more than one retaining hole is provided then the holes may be provided on a radial line from the center of the wheel (not shown). The retaining pin holes 450 in one tang 415 are radially and circumferentially aligned with the corresponding holes in the second tang 415. When the bladed closure bucket 400 is installed in place in the notch, the retaining holes 450 in both tangs 415 also line up radially adjacent to the notch in the male dovetail. The retaining holes 450 in the tangs 415 align radially and circumferentially with retaining pin holes 150 in the notch 120 portion of the wheel 100 (FIG. 3A). A retaining pin 480 is provided for each hole extending through both tangs 410 and the notches. Depending upon the size of the bladed closure bucket 400 and the particular loads on the stage, then one or two pins may be required. For small buckets, the cross pins may not be required.

Figure 5:
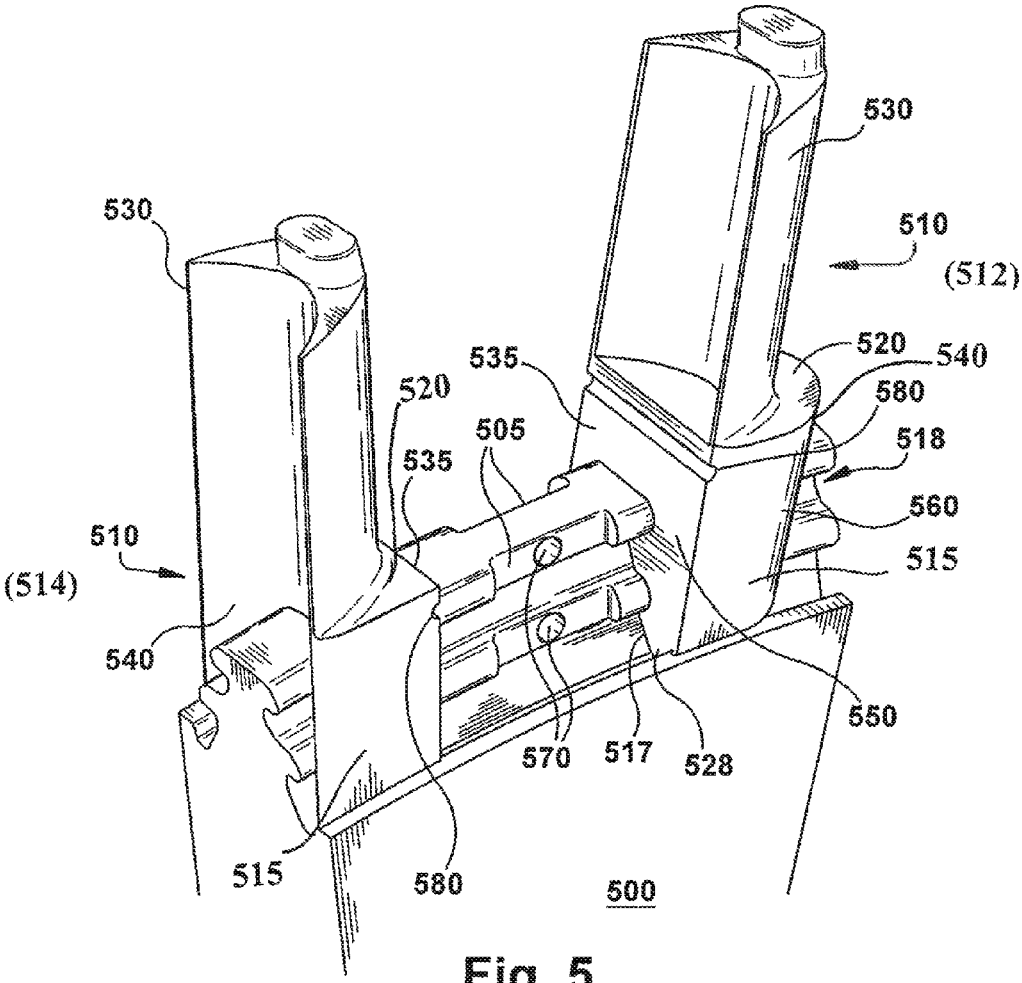
FIG. 5 illustrates adjacent bladed buckets for a fully bladed closure design.

FIG. 5 illustrates adjacent bladed buckets for a fully bladed closure design. The turbine wheel 500 also includes a pair of adjacent buckets 510, one assembled on each side of the notch 505 for the bladed closure bucket (not shown). The adjacent buckets 510 are provided with a root portion 515, a platform 520 and an airfoil 530. The root portion 515 is provided with a female dovetail 517, complementary to the male dovetail 518 on the periphery of wheel 500. The platform 520 is provided with a flat skirt 535 on the circumferential faces adjacent to the bladed closure bucket (not shown) and a round skirt 540 on the circumferential faces opposing the bladed closure bucket. The flat skirt 535 on each circumferential face of the root includes at least one retaining hole 580, generally semicircular in shape and aligned radially with a complementary semicircular hole in the adjacent circumferential face of the bladed closure bucket. The at least one retaining hole 580 extends fully across the axial width of the flat skirts 535. Together these holes define placement for a circular key 475 (FIG. 4B) that provides support from the adjacent blades to lock the bladed closure bucket in place. The retaining holes 580 may be realized with one hole or with two holes at each interface, thereby employing one or two keys to provide support for the bladed closure bucket. By utilizing adjacent buckets with flat skirts 535, the key will be provided support across the full width of the bucket, adding stability to the bucket and providing sufficient surface to overcome the hook shear imposed on the bucket.

Figure 6:
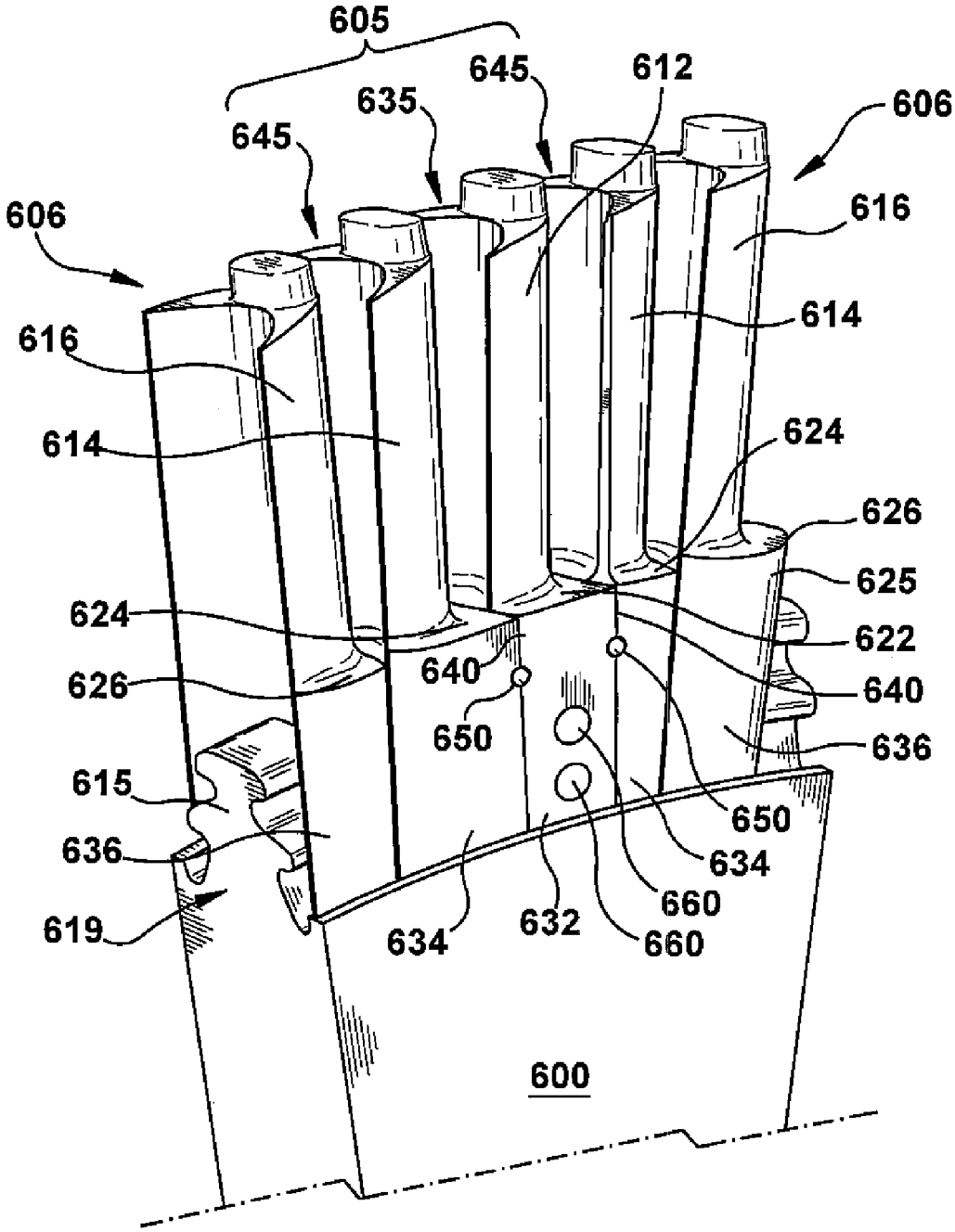
FIG. 6 illustrates a set of buckets for a fully bladed turbine closure on a turbine wheel.

FIG. 6 illustrates a set of buckets 605 for a fully bladed turbine closure design on a turbine wheel 600. In addition to the set of buckets 605, the turbine wheel 600 further includes a plurality of buckets (two buckets shown) 606 assembled on the wheel to fill remaining space on the periphery. The plurality of buckets includes a root portion 636, a platform 626 and airfoil 616. The root portion 636 is formed with a female dovetail (not shown) complementary to the male dovetail 615 on the wheel. The plurality of buckets 606 incorporate platforms 626 formed with rounded skirts 625.

Also referring to FIG. 6, another aspect of the present invention may include a set of bladed buckets 605 for retrofitting a bladeless closure bucket design on a turbine wheel 600. A male dovetail 615 is formed on substantially an entire periphery 619 of the wheel 600, interrupted by a notch (not shown) formed by removal of portions of the male dovetail 615 at a bucket loading location on the periphery 619 of the wheel 600. The set of bladed buckets 605 may include a bladed closure bucket 635 including a root portion 632, a platform 622 and an airfoil 612. The root portion 632 may be formed with a pair of radially inwardly extending laterally spaced tangs 415 (FIG. 4B), and the platform 622 may be formed with a flat skirt 640 on each circumferential face. The set of bladed buckets 605 may also include a pair of adjacent bladed buckets 645, one bladed bucket 645 for assembly on each side of the bladed closure bucket 635. The adjacent bladed bucket 645 may include a root portion 634, a platform 624 and an airfoil 614. The root portion 634 may be formed with a female dovetail (not shown) complementary to the male dovetail 615 on the wheel 600. The platform 624 is formed with a flat skirt 640 on a circumferential face adjacent to the bladed closure bucket 635 and with a rounded skirt 625 on a circumferential face opposed to the bladed closure bucket 645.

The set 605 may further include at least one retaining key 650 connecting the bladed closure bucket 635 and each adjacent bucket 645 through at least one axial hole retaining pin hole 570 (FIG. 5), the retaining pin hole 570 running the full axial length of the flat skirt 640 of the bladed closure bucket and running the full axial length of the flat skirt 640 of the adjacent bucket (FIG. 4, 470). Tangs 415 (FIG. 4B) of the bladed closure bucket defines an opening over which the tangs are adapted to straddle the notch 505 (FIG. 5) on the wheel 600. The tangs may 415 may further include either flat inner faces or tapered inner faces. In the case of the tapered inner faces, the faces taper inward axially from the inner radial portion of the inner faces to the upper radial inner faces. The tangs 415 may include at least one of radially and circumferentially aligned retaining pin holes (FIG. 4A, 450). The retaining pin holes 450 may be radially and circumferentially aligned with the retaining pin holes (FIG. 4A, 450) of the other tang and located radially on a level with the male dovetail 615 when the closure bucket 645 is installed on the wheel 600. The set will also include at least one retaining pin 660 for insertion through the at least one of radially and circumferentially aligned retaining pin holes 450 in each tang 415 and the retaining pin holes of the notch (FIG. 5, 505) in the peripheral margin of the wheel 600.

The adjacent buckets 645 of the set 605 may also include a platform 626 with a rounded skirt 625 on each circumferential face opposite from the bladed closure bucket 645. On the circumferential faces adjacent to the bladed closure bucket 635, the adjacent buckets 645 provide flat skirts 640. The flat skirt 640, may be formed with at least one hole (FIG. 5, 580) for retaining keys. The at least one hole is radially aligned with a complementary hole or holes (FIG. 4A, 470) on the bladed closure bucket 635. Each of the holes on the adjacent buckets 645 and the bladed closure bucket 635 may be generally semicircular, thereby forming a generally round hole for retaining keys 650. More than one retaining key may be utilized at the interface between the bladed closure bucket 635 and the adjacent buckets 645. Flat skirts permit the retaining key or keys—to maintain contact with the full axial length of the both the bladed closure bucket 635 and the adjacent buckets 645 along the flat skirt, providing superior contact to hold the bladed closure bucket 635 in place.

Figure 1:
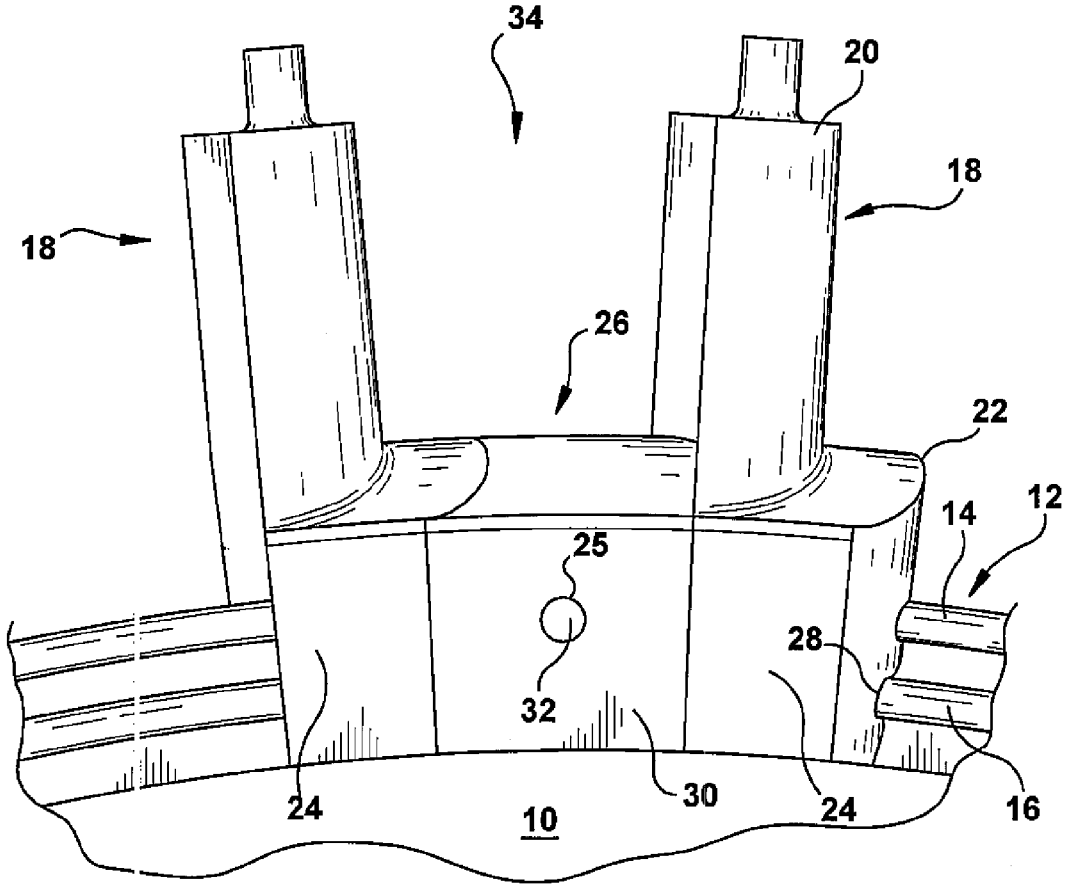
Fig. 1 (PRIOR ART)
FIG. 1 illustrates a prior art unbladed closure block installed in a closure notch of a dovetailed peripheral margin of a turbine wheel.
Figure 2:
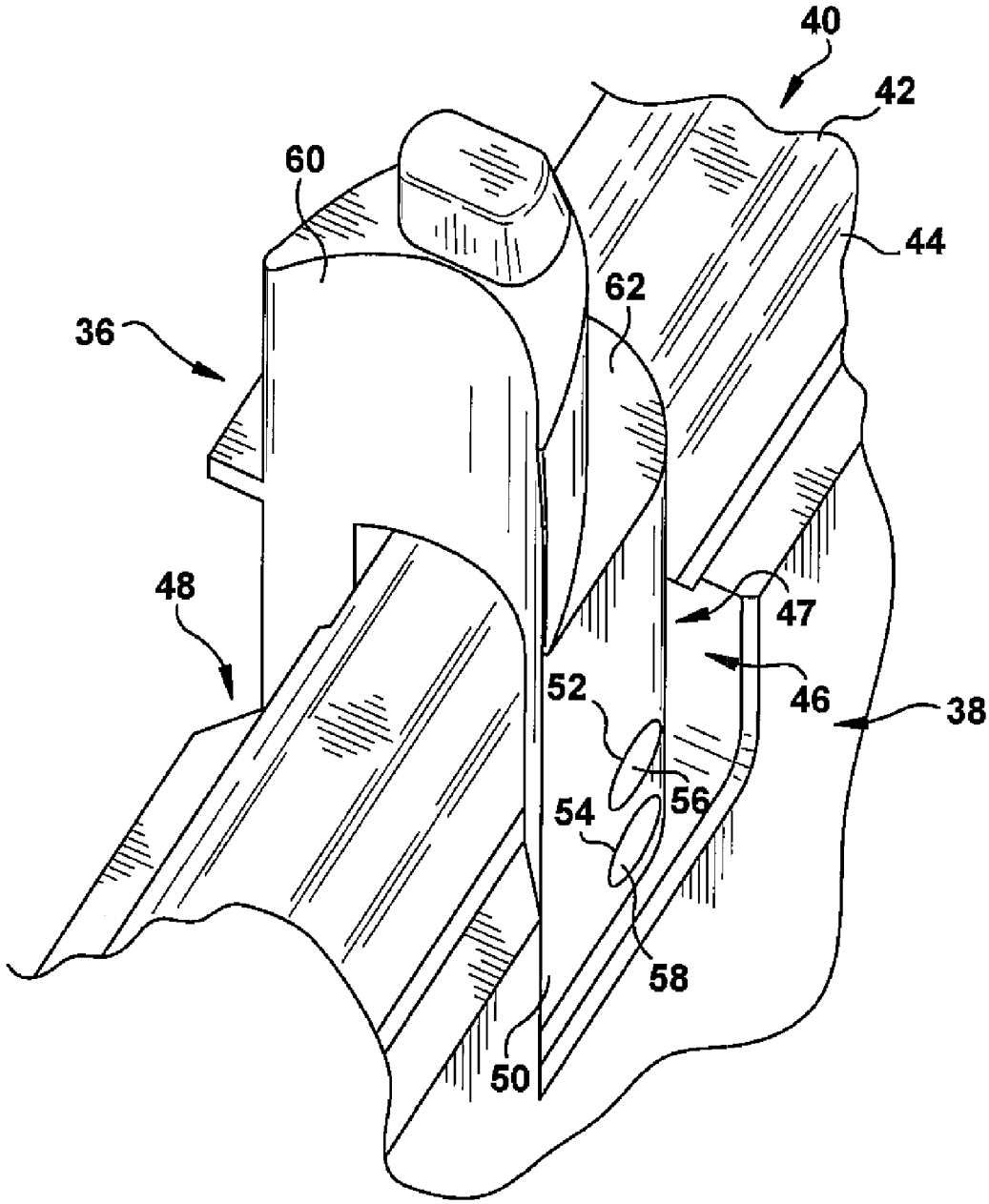
Fig. 2 (PRIOR ART)
FIG. 2 illustrates a prior art bladed closure block with a deep cut notch in the turbine wheel.

A method may be provided for retrofitting a bladeless closure design of tangential entry round skirt buckets and a non-bladed closure block in a turbine wheel with a fully bladed closure to improve the efficiency of the blade. The method may include removing the bladeless closure block 26 and the adjacent buckets 18 (a trailing bucket and a leading bucket with round skirts adjacent to the closure block) from the wheel (FIG. 1).

Now, referring to FIGS. 4A, 4B, 5 and 6, installation will be described. A leading bucket 512, with a round skirt 540 on a leading edge and a flat skirt 535 on a trailing edge, is mounted through the closure notch 505 and positioned onto a male dovetail 518 of the wheel 500. Then a trailing bucket 514, including a round skirt 540 on a trailing edge and a flat skirt 535 on a trailing edge, is installed through the closure notch 515 and positioned onto the male dovetail 518 of the wheel. A bladed closure bucket 635, with a flat skirt 640 on a leading edge and a trailing edge, is inserted through the closure notch 505 onto the male dovetail 518 of the wheel (FIG. 6).

The method may further include keying the bladed closure bucket 635 in place on the wheel 600 with at least one retaining key 650 locking the closure bucket 635 and each adjacent bucket 645. The method for retrofitting the bladed closure design may also include pinning the bladed closure bucket 635 in place on the wheel 600 with at least one retaining pin 660, the at least one retaining pin 660 being placed axially through at least one retaining hole 450 in each tang 415 of the bladed closure bucket 635 radially and circumferentially aligned with at least one of retaining holes in the notched peripheral margin of the wheel. The method may also include a combination of both methods for securing the bladed closure bucket in place. In other words, the method may provide for keying the bladed closure bucket in place on the wheel with at least one retaining key connecting the closure bucket and each adjacent bucket. The method may achieve further strength by pinning the bladed closure bucket 635 in place on the wheel 600 with at least one retaining pin 660. The at least one retaining pin 660 may be placed axially through at least one retaining hole 580 in each tang 415 of the bladed closure bucket 635 being radially and circumferentially aligned. The at least one retaining pin 660 further being aligned with at least one of retaining holes 570 in the notched male dovetail 518 of the wheel 600.

While various embodiments are described herein, it will be appreciated from the specification that various combinations of elements, variations or improvements therein may be made, and are within the scope of the invention.

The invention claimed is:

1. A method for retrofitting a bladeless closure design of tangential entry round skirt buckets and a non-bladed closure bucket in a turbine wheel with a fully bladed closure set, the method comprising:

removing the bladeless closure bucket from a peripheral margin of the wheel through a closure notch;

removing an adjacent bladed trailing bucket with a round skirt dovetail from a peripheral margin of the wheel through the closure notch;

removing an adjacent bladed leading bucket with a round skirt from the peripheral margin of the wheel through the closure notch;

installing an adjacent leading bladed bucket, including a round skirt on a leading edge and a flat skirt on a trailing edge, through the closure notch onto a peripheral margin of the wheel;

installing an adjacent trailing bladed bucket, including a round skirt on a trailing edge and a flat skirt on a leading edge, through the closure notch onto the peripheral margin of the wheel; and installing a bladed closure bucket, including flat skirts on both a leading edge and a trailing edge, through the closure notch onto the peripheral margin of the wheel.

2. The method for retrofitting the bladeless closure design of claim 1, the installing of the bladed closure bucket further comprising:

keying the bladed closure bucket in place on the wheel with at least one retaining key connecting the bladed closure bucket and each adjacent bladed bucket across the flat skirt faces of the bladed closure bucket and the adjacent bladed bucket.

3. The method for retrofitting the bladed closure design of claim 1, the installing of the bladed closure bucket further comprising:

pinning the bladed closure bucket in place on the wheel with at least one retaining pin, the at least one retaining pin being fitted axially through at least one retaining hole in each tang of a pair of tangs of the bladed closure bucket and through at least one of retaining holes in the notched peripheral margin of the wheel.

4. The method for retrofitting the bladed closure design of claim 1, the installing of the bladed closure bucket further comprising:

keying the bladed closure bucket in place on the wheel with at least one retaining key connecting the closure bucket and each adjacent bladed bucket across the flat skirt faces of the bladed closure bucket and the adjacent bladed bucket; and pinning the bladed closure bucket in place on the wheel with at least one retaining pin, the at least one retaining pin being placed axially through at least one retaining hole in each tang of a pair of tangs of the bladed closure bucket and with at least one of retaining holes in the notched peripheral margin of the wheel.

* * * * *